US010058754B2

(12) United States Patent
Parker et al.

(10) Patent No.: US 10,058,754 B2
(45) Date of Patent: Aug. 28, 2018

(54) GAME APPARATUS

(71) Applicants: Andrew C. Parker, Casselberry, FL (US); Timothy D. Nichols, Casselberry, FL (US)

(72) Inventors: Andrew C. Parker, Casselberry, FL (US); Timothy D. Nichols, Casselberry, FL (US)

( * ) Notice: Subject to any disclaimer, the term of this patent is extended or adjusted under 35 U.S.C. 154(b) by 359 days.

(21) Appl. No.: 14/212,505

(22) Filed: Mar. 14, 2014

(65) Prior Publication Data

US 2014/0265136 A1 Sep. 18, 2014

Related U.S. Application Data

(60) Provisional application No. 61/799,644, filed on Mar. 15, 2013.

(51) Int. Cl.

| | |
|---|---|
| ***A63B 63/00*** | (2006.01) |
| ***A63B 67/06*** | (2006.01) |
| ***A63B 67/00*** | (2006.01) |
| ***A63B 67/04*** | (2006.01) |
| *A63F 9/00* | (2006.01) |

(52) U.S. Cl.

CPC ..... *A63B 63/00* (2013.01); *A63B 67/002* (2013.01); *A63B 67/04* (2013.01); *A63B 67/06* (2013.01); *A63B 2225/09* (2013.01); *A63F 2009/0058* (2013.01); *A63F 2250/024* (2013.01)

(58) Field of Classification Search

CPC ..... A63B 63/08
USPC ..... 273/336, 352, 398–402; 211/81, 85; 248/311.2, 315

See application file for complete search history.

(56) References Cited

U.S. PATENT DOCUMENTS

| | | | | |
|---|---|---|---|---|
| 1,542,063 | A * | 6/1925 | Knight | 273/399 |
| 1,601,040 | A * | 9/1926 | Phillips | A47F 7/283 211/75 |
| D235,897 | S * | 7/1975 | Breneman | D21/702 |
| 4,378,889 | A * | 4/1983 | Lebowitz | A47J 47/16 211/74 |
| 5,064,195 | A * | 11/1991 | McMahan et al. | 473/480 |
| 5,139,222 | A * | 8/1992 | Koorey et al. | 248/311.2 |

(Continued)

OTHER PUBLICATIONS

BasketPong Beer Pong Game, YouTube video, https://www.youtube.com/watch?v=0tYuRsRNiEM, uploaded on Jan. 25, 2012.*

*Primary Examiner* — Melba Bumgarner
*Assistant Examiner* — Laura L Davison
(74) *Attorney, Agent, or Firm* — Matthew G. McKinney, Esq.; Allen, Dyer et al.

(57) ABSTRACT

A game apparatus with pivotally mounted cup holders is disclosed. The apparatus includes a game board and a plurality of cup holders pivotally secured to a vertical surface of the game board. The cup holders are configured to pivot relative to the vertical surface of the game board to hold a cup at an angle. In addition, the game board includes a cavity formed into the game board for each cup holder, where the cavity is configured to receive and support a portion of a bottom edge of a cup. A depression is formed into the game board and configured to receive a respective cup holder to lay flat when the cup holder is pivoted against the game board. Further, the plurality of cup holders are disposed in a triangular formation on the game board and configured for cups to be placed adjacent to one another.

4 Claims, 7 Drawing Sheets

(56) References Cited

U.S. PATENT DOCUMENTS 5,423,508 A * 6/1995 Isenga et al. ..... 248/311.2
8,651,492 B1 * 2/2014 Cappuccio ..... 273/348

* cited by examiner

GAME APPARATUS

I. FIELD

The present invention relates in general to a game apparatus for playing a game commonly known as "beer pong."

II. DESCRIPTION OF RELATED ART

Beer pong is a popular game among young people and it is typically played on a table top where an array of plastic cups are generally placed on a flat table top in a triangle formation on both ends of the table. Each cup has a beer or other liquids placed inside of the cups. Players on each side of the table alternatively attempt to throw a ping pong ball into the cups on the other side of the table. When a throw successfully lands in a cup, the opposing team must drink the contents of the cup in which the ball landed and the cup is removed from play. The objective is to remove all cups from play on the opposing side of the table. A limitation of the typical beer pong game is that there is limited opportunity to increase the game play challenge beyond merely rearranging the cups on the table top and also that the game play is limited to flat table tops.

A need therefore exists for a game apparatus for playing beer pong with a similar triangular arrangement of cups that can be played in a variety of setting where space is limited or the difficulty of game play can be increased.

However, in view of the prior art at the time the present invention was made, it was not obvious to those of ordinary skill in the pertinent art how the identified needs could be fulfilled.

III. SUMMARY

A game apparatus with pivotally mounted cup holders is disclosed. The apparatus includes a game board that is orientated in a vertical plane and a plurality of cup holders pivotally secured to a vertical surface of the game board, where the cup holders are configured to pivot to hold a cup between about 30 degrees and 60 degrees relative to the vertical surface of the game board. The game board also includes a cavity formed into the game board for each cup holder, where the cavity is configured to receive and support a portion of a bottom edge of a cup placed in the respective cup holder. In addition, the apparatus may include a pair of removable legs mounted to opposing sides of the game board to provide free-standing support of the game board in a vertical orientation. The game board may also include an aperture for hanging the game board on a wall so that the legs can be removed when not needed. The game board further includes a depression formed into the game board and configured to receive a respective cup holder to lay flat when the cup holder is pivoted against the game board. The plurality of cup holders are disposed in a triangular formation on the game board and configured for cups to be placed adjacent to one another on the game board.

The cup holders are configured to angle the mouth of each cup outwards away from the game board so that a ball can be tossed inside. In standard game play the cups are placed in the cup holders in the standard triangular tight formation, which is accomplished because the mouths of the cups are orientated at the desired angle. In non-standard game play the cups can be positioned in a variety of alternate positions by only placing cups in certain cup holders or by relocating cup holders on the game board as desired. Additional game variations are achievable and a range of different sized cups can be accommodated by the cup holders. Generally, the degree of the angle between the cup and the vertical surface of the game board will vary depending on the size and shape of the cups, the weight of liquid place inside the cups, and the placement of cups within the cup holders.

Other aspects, advantages, and features of the present disclosure will become apparent after review of the entire application, including the following sections: Brief Description of the Drawings, Detailed Description, and the Claims.

IV. BRIEF DESCRIPTION OF THE DRAWINGS

V. DETAILED DESCRIPTION

The word "exemplary" is used herein to mean "serving as an example, instance, or illustration." Any embodiment or design described herein as "exemplary" is not necessarily to be construed as preferred or advantageous over other embodiments or designs.

Figure 1:
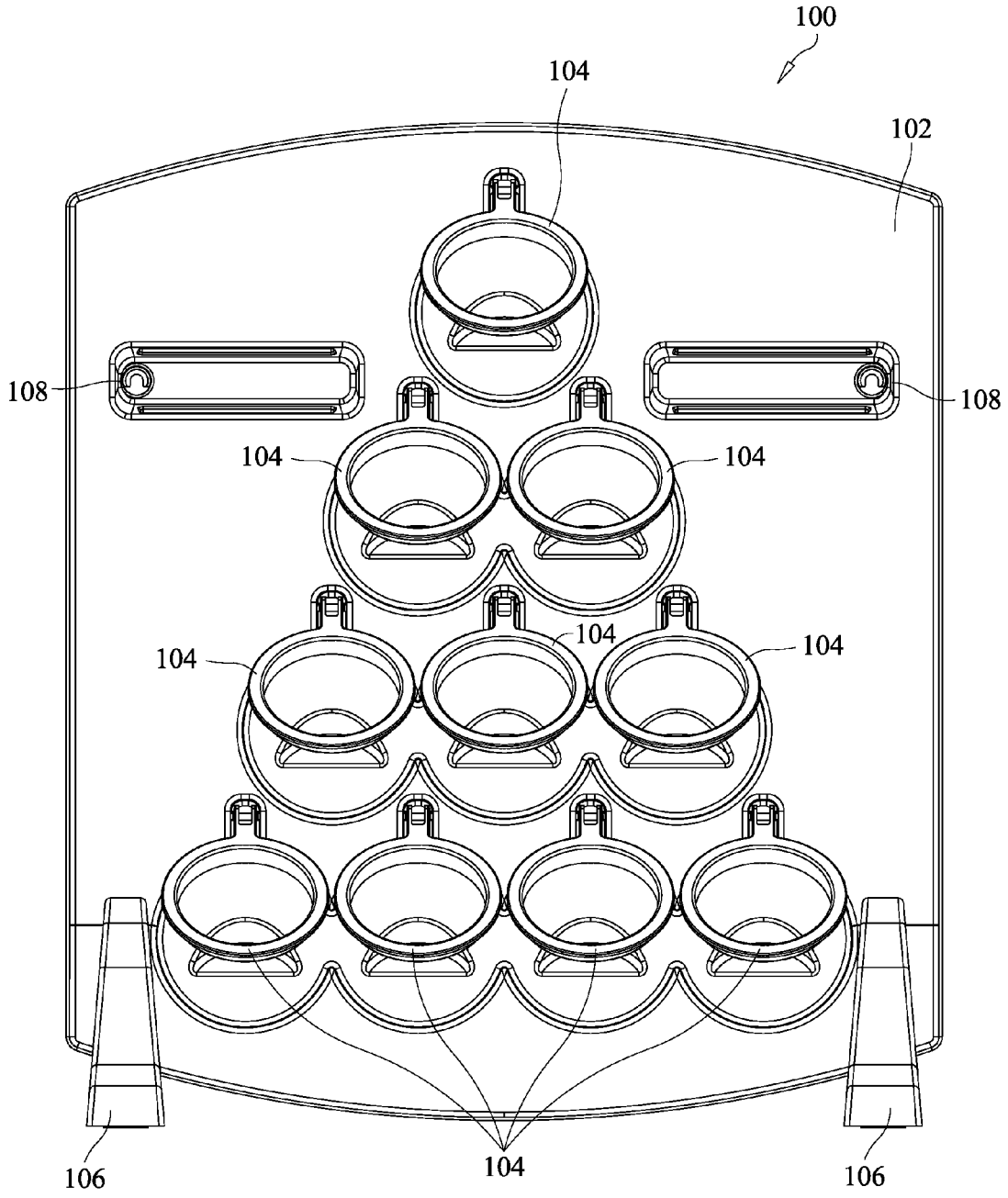
FIG. 1 is an elevational front view of a particular embodiment of a game apparatus.
Figure 2:
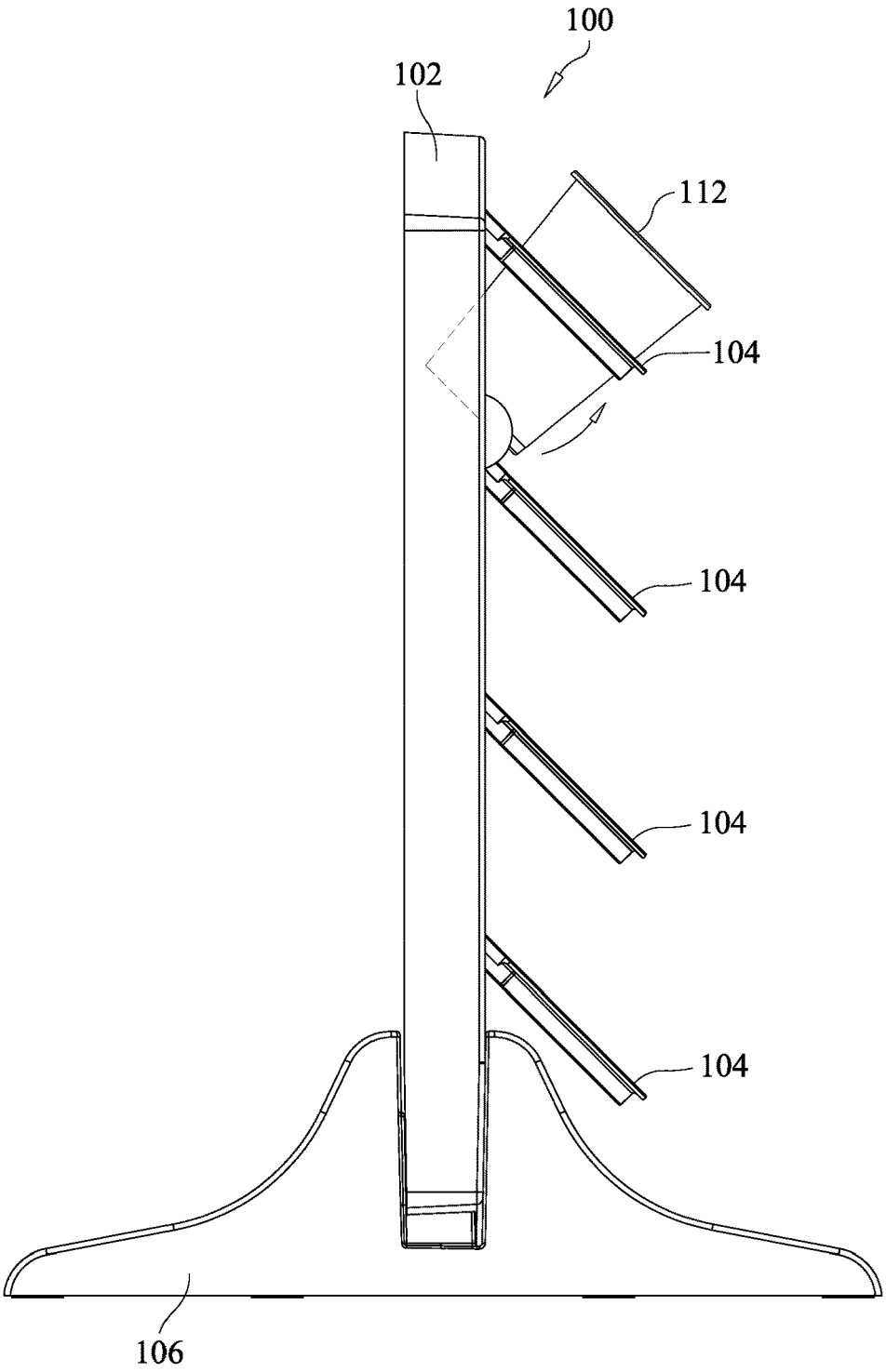
FIG. 2 is a side elevational view of the game apparatus of FIG. 1.
Figure 3:
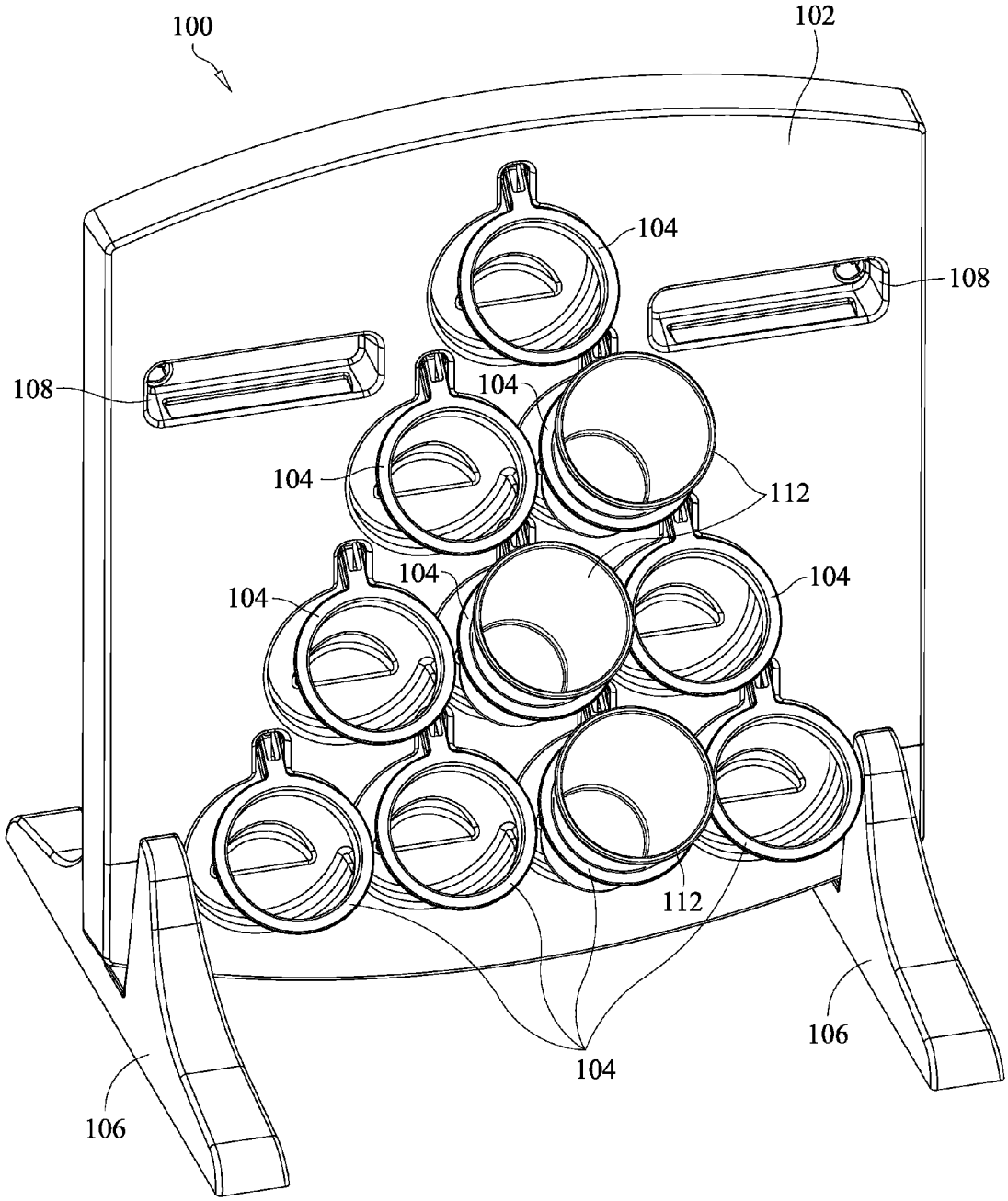
FIG. 3 is a perspective view of the game apparatus.

Referring to FIGS. 1-3, a particular illustrative embodiment of a game apparatus is disclosed and generally designated 100. The apparatus 100 includes a game board 102 and cup holders 104 pivotally attached to the game board 102. The cup holders 104 are configured to hold a typical plastic drinking cup 112 in place without the cup 112 falling through. In this particular embodiment there are a total of ten cup holders 104 in a vertical orientation and arranged in a tight triangle shape. There is one cup holder 104 in the top row, two cup holders 104 in the second row, three cup holders 104 in the third row, and four cup holders 104 in the bottom or last row. However, the size and shape of the game board 102 can be reduced or increased to accommodate the desired number of the cup holders 104.

The game board 102 may include removable or permanent support legs 106 attached to opposing sides of the game board 102 so that the game board is supported in a vertical orientation. Accordingly, the game apparatus 100 may be set up on a table or used poolside, for example. The game board 102 may also be mounted to a wall or support structure using a wire or a hook without the use of the support legs 106. The game board 102 may also be configured to be mounted or supported at varying angles relative to the vertical orientation to change game play. In addition, a pair of slots 108 may be disposed in the game board 102 that hold typical ping pong type balls used with the beer pong game.

Figure 4:
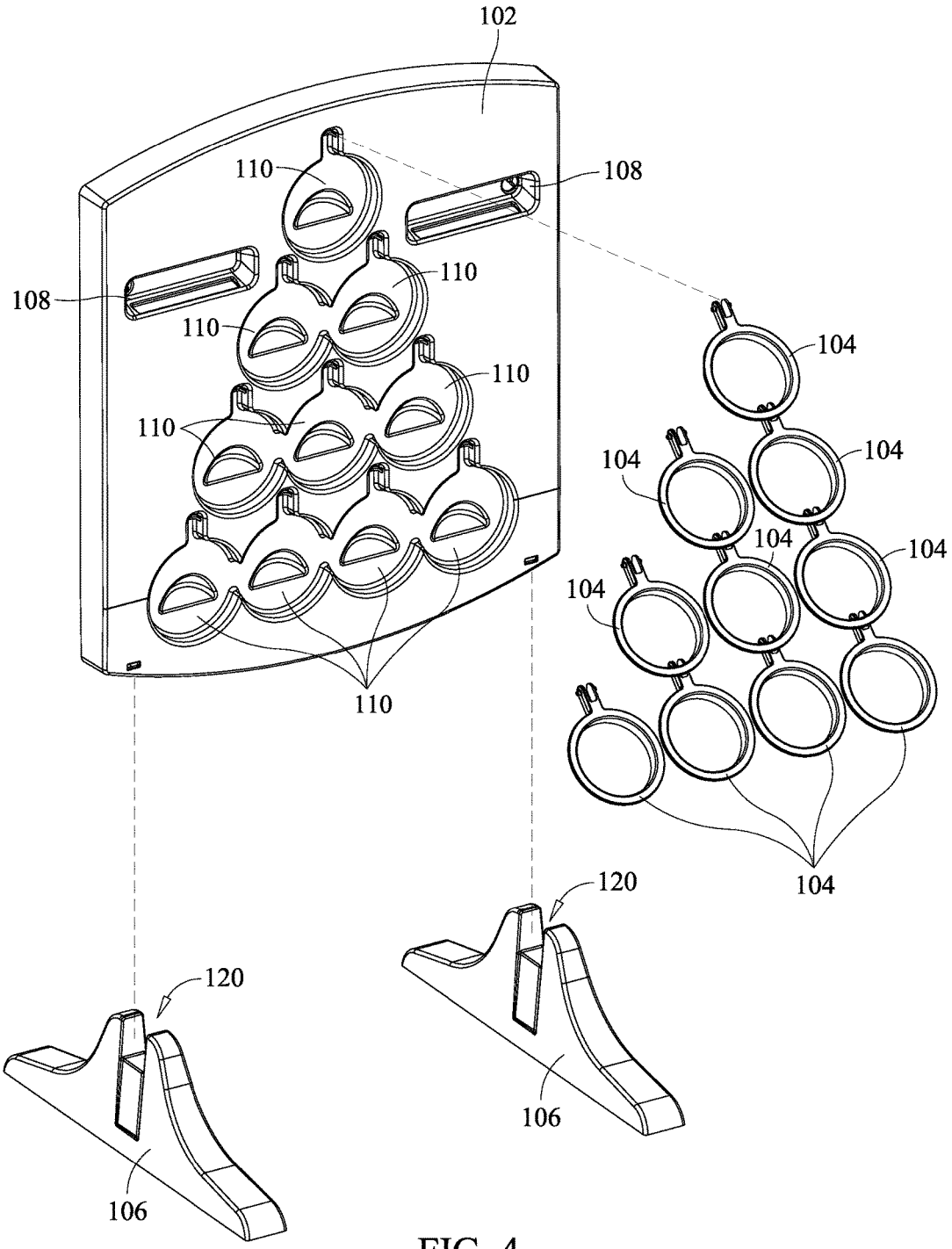
FIG. 4 is an exploded perspective view of the game apparatus.

Referring now to FIG. 4, the game board 102 is shown separate from the support legs 106. The support legs 106 each include a notch 120 for receiving a bottom edge of the game board 102. Accordingly, the game board 102 can slidingly engage the respective notch 120 and be secured using a friction fit.

Figure 5:
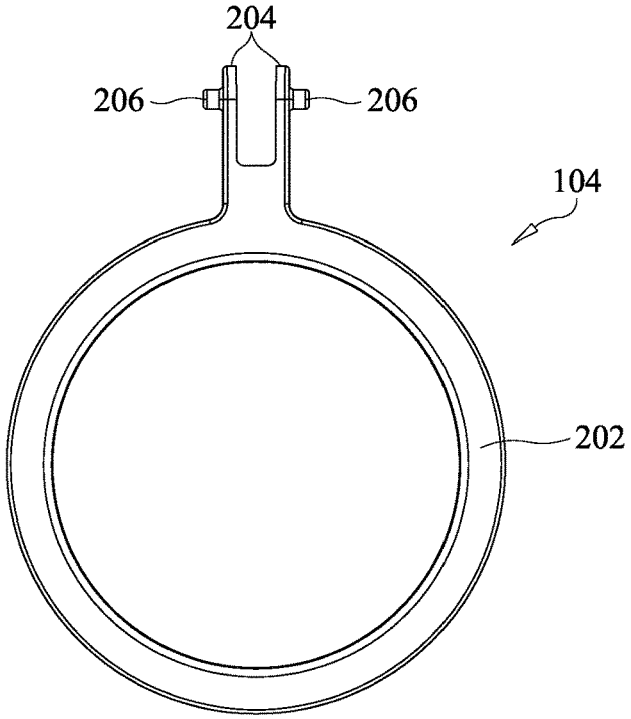
FIG. 5 is a top view of a cup holder of the game apparatus.
Figure 6:
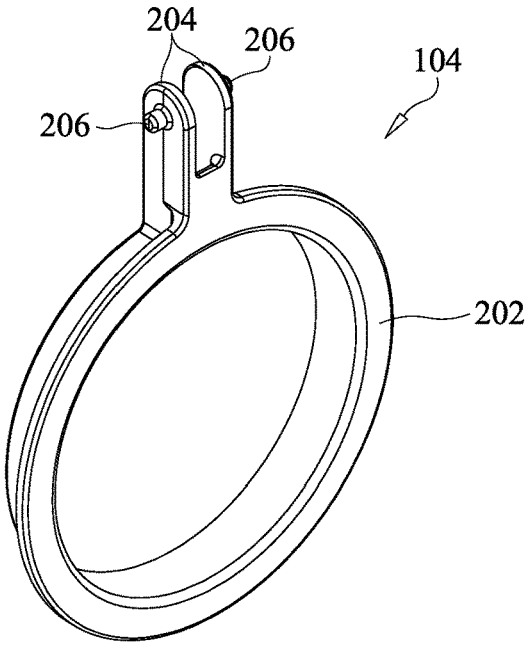
FIG. 6 is a perspective view of the cup holder.
Figure 7A:
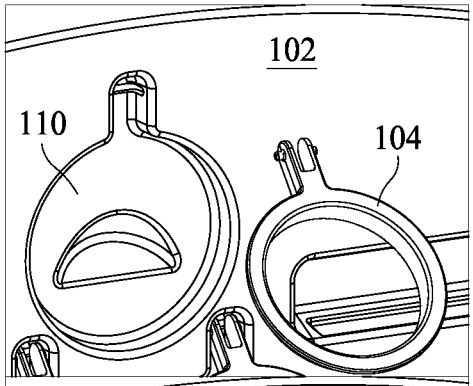
FIG. 7A is a detail view of the cup holder to be installed to a game board.
Figure 7B:
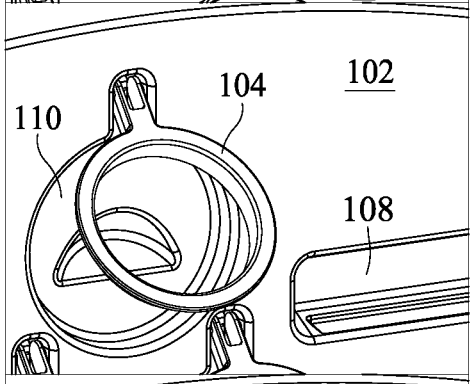
FIG. 7B is a detail view of the cup holder snapped into the game board.
Figure 7C:
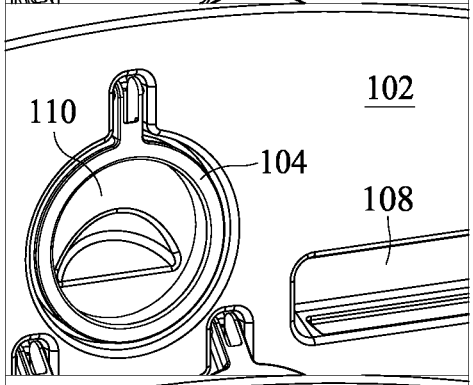
FIG. 7C is a detail view of the cup holder folded flush to the game board.
Figure 7D:
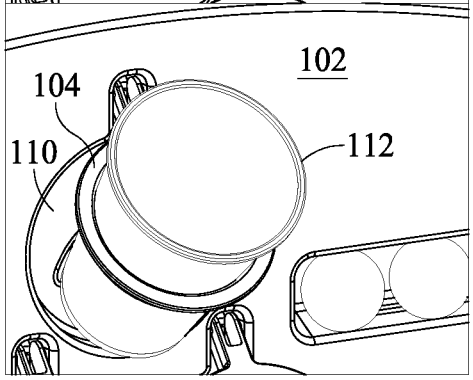
FIG. 7D is a detail view of the cup holder with a cup placed in the cup holder.

Referring now to FIGS. 5 and 6, the cup holders 104 each include a ring 202 and an arm 204 extending from an edge of the ring 202. The ring 202 may include a flange disposed along a periphery of an upper edge. A proximal end of each arm 204 includes a nub or projection 206 on each side of the arm 204, where the projections 206 are configured to snap into a receptacle disposed within a respective depression 110 of the game board. The projections 206 may be a peg, spherical, or other shape that allows the connection from the cup holder 204 to the game board 102 to pivot. Accordingly, once the free end of the arm 204 of the cup holder 104 is snapped into place within the respective receptacle of the depression 110, the cup holder 104 can pivot to hold a cup between about 30 and 60 degrees. Alternatively, the arm 204 may be coupled to the game board 102 using a pin, bolt, magnet, or other fastener. The cup holders 104 hold the mouths of the cups at an angle relative to the game board so that the cups can be grouped closely together as in the standard beer pong game played on a flat surface. The cup holders 104 can pivot freely so that the cup holder 104 can rotate up or down to accommodate and hold various sized cups at the desired angle.

The plurality of depressions 110 are sized and shaped to receive a respective cup holder 104 when the cup holder 104 is folded flush against the game board 102 as shown in FIGS. 7A-7D. For example, when a ball is tossed into a cup, that cup is removed from the respective cup holder 104 and the cup holder 104 can be pivoted downward to fold flat into the depression 110. Once the cup holder 104 is folded to the game board 102, then it will not interfere with another ball being tossed into remaining cups on the game board 102. Each of the depressions 110 is defined by arcuate sidewalls extending into the front vertical surface towards the rear vertical surface of the game board 102 to define a rear surface that is parallel to the front vertical surface of the game board. The depression 110 also includes a cavity formed into the game board 102 for each cup holder 104, where the cavity is configured to receive and support a portion of a bottom edge of a cup placed in the respective cup holder 104. The cavity is wedge shaped where a bottom surface of the cavity is flat at about a 45 degree angle relative to the vertical surface of the game board 102 to support the bottom edge of the cup. In particular each of the wedge shaped cavities is formed into the rear surface of a respective depression 110 and has a top semi-circular sidewall extending into the rear surface of the depression 110 towards the rear vertical surface of the game board 102. A semi-circular bottom surface of the wedge shaped cavity extends upwards from a bottom horizontal edge of each wedge shaped cavity to intersect the top semi-circular sidewall.

Further, the movement of the cup holders 104 may be accomplished thru manual or automatic positioning. For example, mechanisms such as gears, motors, jackscrews, and other known translating devices can be applied to pivot and move the cup holders 104. Control of the cup holder 104 translation may be provided using control devices including computer control, WIFI control, mobile device control, remote control, pre-programmed control, dynamic control, or cam path control techniques, among other known motion control techniques.

Figure 8:
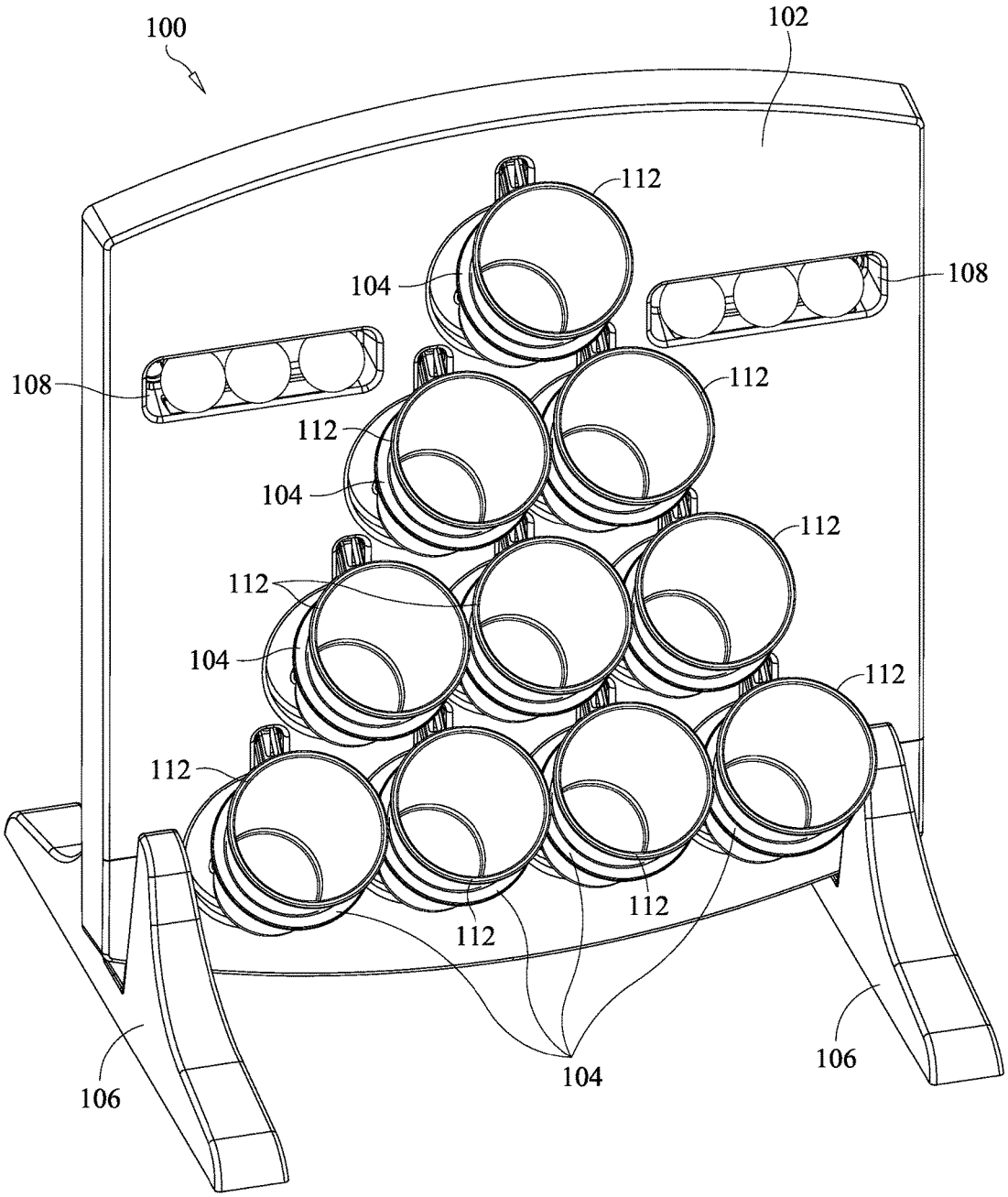
FIG. 8 is a perspective view of the game apparatus with the cups placed in each of the cup holders and ready for play.

Referring now to FIG. 8, a cup 112 has been placed in each of the cup holders 104. As explained above, the cup holders 104 are configured to support the cups 112 so that the mouth of each cup 112 is at an angle to the game board 102 so that a player can toss a ball in to a desired cup 112. In addition, a variety of target elements (not shown) may be secured to the cup holder 104 either as independent components or as target elements which combine with the cup 112 inserted into the cup holder 104. These target elements may include sensor devices which register when the target has been hit or that a ball has landed in the respective cup 112. Accordingly, feedback devices such as light emitting devices or sound emitting devices, which output light or sound when a target has and/or has not been hit, can be triggered to display an electronic score. Physical response devices, such as a device that ejects the ball from the cup 112, may also be included with the game apparatus 100.

The previous description of the disclosed embodiments is provided to enable any person skilled in the art to make or use the disclosed embodiments. Various modifications to these embodiments will be readily apparent to those skilled in the art, and the principles defined herein may be applied to other embodiments without departing from the scope of the disclosure. Thus, the present disclosure is not intended to be limited to the embodiments shown herein but is to be accorded the widest scope possible consistent with the principles and novel features.

What is claimed is:

1. A game apparatus, the apparatus comprising:

a game board having a front vertical surface and a rear vertical surface;

a plurality of cup holders pivotally secured to the game board, wherein the plurality of cup holders are configured to pivot relative to the front vertical surface of the game board to hold a mouth of a respective cup tilted forward relative to the front vertical surface of the game board;

a plurality of depressions defined by arcuate sidewalls extending into the front vertical surface towards the rear vertical surface of the game board to define a rear surface that is parallel to the front vertical surface, wherein the plurality of cup holders are pivotally secured within the plurality of depressions the plurality of depressions are positioned to receive the plurality of cup holders when folded down adjacent to the front vertical surface; and a plurality of wedge shaped cavities formed into the rear surface of the plurality of depressions, wherein each wedge shaped cavity having a top semi-circular sidewall extending into the rear surface of a respective depression towards the rear vertical surface, and a semi-circular bottom surface extends upwards from a bottom horizontal edge of each wedge shaped cavity to intersect the top semi-circular sidewall, the semi-circular bottom surface being at about a 45 degree angle relative to the front vertical surface of the game board and configured to receive and support a portion of a bottom of a cup placed in the respective cup holder and tilted forward relative to the front vertical surface of the game board.

2. The game apparatus of claim 1, further comprising a pair of removable legs mounted to opposing sides of the game board to support the game board in a vertical orientation.

3. The game apparatus of claim 1, wherein the plurality of cup holders are disposed in a triangular formation on the game board and configured for cups to be placed adjacent to one another on the game board.

4. The game apparatus of claim 1, wherein the cup holders are configured to pivot between about 0 degrees and 60 degrees relative to the vertical surface of the game board.

* * * * *